US008556380B2

(12) United States Patent
Murata

(10) Patent No.: US 8,556,380 B2
(45) Date of Patent: Oct. 15, 2013

(54) LIQUID DISCHARGE APPARATUS

(75) Inventor: Satoshi Murata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 17 days.

(21) Appl. No.: 13/431,750

(22) Filed: Mar. 27, 2012

(65) Prior Publication Data

US 2013/0002762 A1 Jan. 3, 2013

(30) Foreign Application Priority Data

Jun. 30, 2011 (JP) ..... 2011-146490

(51) Int. Cl.
*B41J 2/145* (2006.01)

(52) U.S. Cl.
USPC ..... 347/40; 347/68

(58) Field of Classification Search
USPC ..... 347/40, 43, 49, 67, 68
See application file for complete search history.

(56) References Cited

U.S. PATENT DOCUMENTS

| | | | | |
|---|---|---|---|---|
| 5,291,227 | A * | 3/1994 | Suzuki | 347/104 |
| 5,997,129 | A * | 12/1999 | Matsuhashi | 347/35 |
| 6,239,817 | B1 | 5/2001 | Meyer | |
| 2002/0089564 | A1 | 7/2002 | Ohashi | |
| 2004/0135865 | A1 | 7/2004 | Nunokawa | |
| 2004/0165019 | A1 | 8/2004 | Ohashi | |
| 2005/0122375 | A1 | 6/2005 | Otsuki | |
| 2006/0274138 | A1 | 12/2006 | Nunokawa | |
| 2007/0109384 | A1 | 5/2007 | Takeda et al. | |
| 2008/0043056 | A1 | 2/2008 | Nunokawa | |
| 2008/0180507 | A1 | 7/2008 | Furukawa | |

FOREIGN PATENT DOCUMENTS

| | | | |
|---|---|---|---|
| JP | H07-025083 | A | 1/1995 |
| JP | 2000-118058 | A | 4/2000 |
| JP | 2002-086821 | A | 3/2002 |
| JP | 2002-103706 | A | 4/2002 |
| JP | 2002-192713 | A | 7/2002 |
| JP | 2004-034522 | A | 2/2004 |
| JP | 2005-022318 | A | 1/2005 |
| JP | 2005-111984 | A | 4/2005 |
| JP | 2008-179106 | A | 8/2008 |
| JP | 2009-083364 | A | 4/2009 |

* cited by examiner

*Primary Examiner* — Lamson Nguyen
(74) *Attorney, Agent, or Firm* — Baker Botts L.L.P.

(57) ABSTRACT

A liquid discharge apparatus includes a conveyer, a liquid discharge head, and a supporter. The conveyer is configured to convey a recording medium in a conveying direction parallel to a reference line. The liquid discharge head includes a discharge surface that includes discharge portions and a non-discharge portion. The non-discharge portion is disposed between two adjoining discharge portions and extends to converge on the reference line from an upstream side toward a downstream side in the conveying direction. The supporter includes a projection that includes a top portion facing the non-discharge portion and extending along the non-discharge portion. The top portion is configured to support the recording medium. The top portion is sloped, such that a distance between the top portion and the discharge surface increases from the upstream side toward the downstream side in the conveying direction.

15 Claims, 10 Drawing Sheets

LIQUID DISCHARGE APPARATUS

CROSS REFERENCE TO RELATED APPLICATION

This application claims priority from Japanese Patent Application No. 2011-146490, filed Jun. 30, 2011, which is incorporated herein by reference.

BACKGROUND OF THE INVENTION

1. Field of the Invention

The invention relates generally to liquid discharge apparatus that discharge liquid at recording media.

2. Description of Related Art

A known liquid discharge apparatus includes a conveyer, a liquid discharge head, and a supporter. The conveyer is configured to convey a recording medium in a conveying direction. The liquid discharge head includes a discharge surface, which includes a discharge portion and a non-discharge portion. The supporter includes a portion configured to support a recording medium conveyed by the conveyer. The liquid discharged from the discharge portion of the liquid discharge head does not adhere easily to the portion of the supporter that supports the recording medium, thereby preventing contamination of the recording medium by liquid adhering to the supporting portion.

SUMMARY OF THE INVENTION

In a liquid discharge head that has a non-discharge portion extending to intersect the conveying direction, the supporter may include a projection, with the top portion of the projection configured to support the recording medium. Because the non-discharge portion extends to intersect the conveying direction, the direction in which the top portion of the projection extends also may be the direction in which the non-discharge portion extends. Contamination of the recording medium by the liquid adhering to the top portion may be reduced because the liquid discharged from the discharge portion does not adhere easily to the top portion. Nevertheless, if the top portion extends to intersect the conveying direction so as to approach a reference line (i.e., a line parallel to the conveying direction, extending along the center or one side of the recording medium) pointing toward a downstream side, from an upstream side, in the conveying direction, a downstream end corner of the recording medium that is bent downward may contact the projection during conveyance of the recording medium. This contact between the downstream end corner of the recording medium and the projection may cause poor conveyance of the recording medium. "Poor conveyance," as used hereafter, includes contact between the recording medium and the discharge surface or jamming of the recording medium, or both. Therefore, a need has arisen for a liquid discharge apparatus that overcomes this shortcoming.

According to embodiments of the invention, a liquid discharge apparatus may comprise a conveyer configured to convey a recording medium in a conveying direction parallel to a reference line, a liquid discharge head, and a supporter. The liquid discharge head may comprise a discharge surface comprising a plurality of discharge portions, each of the plurality of discharge portions comprising a plurality of discharge ports from which liquid is discharged, and a particular non-discharge portion disposed between two adjoining discharge portions and extending to converge on the reference line from an upstream side toward a downstream side in the conveying direction. The supporter may comprise a projection comprising a particular top portion facing the particular non-discharge portion and extending along the non-discharge portion. The particular top portion may be configured to support the recording medium conveyed by the conveyer and may be sloped, such that a distance between the particular top portion and the discharge surface increases from the upstream side toward the downstream side in the conveying direction.

According to other embodiments of the invention, a liquid discharge apparatus may comprise a conveyer configured to convey a recording medium in a conveying direction parallel to a reference line, a liquid discharge head, and a supporter. The liquid discharge head may comprise a discharge surface comprising a plurality of discharge portions, each of the plurality of discharge portions comprising a plurality of discharge ports from which liquid is discharged, and a particular non-discharge portion disposed between two adjoining discharge portions and extending to converge on the reference line from an upstream side toward a downstream side in the conveying direction. The supporter may comprise a particular projection comprising a particular top portion facing the particular non-discharge portion and extending along the particular non-discharge portion. The particular top portion may be configured to support the recording medium conveyed by the conveyer and may be sloped, such that a distance between the particular top portion and the discharge surface increases toward the reference line in a direction perpendicular to an extending direction of the particular top portion.

Other objects, features, and advantages will be apparent to persons of ordinary skill in the art from the following detailed description of embodiments of the invention and the accompanying drawings.

BRIEF DESCRIPTION OF THE DRAWINGS

For a more complete understanding of embodiments of the invention, needs satisfied thereby, and the objects, features, and advantages thereof, reference now is made to the flowing descriptions taken in connection with the accompanying drawings.

DETAILED DESCRIPTION OF EMBODIMENTS OF THE INVENTION

Figure 1:
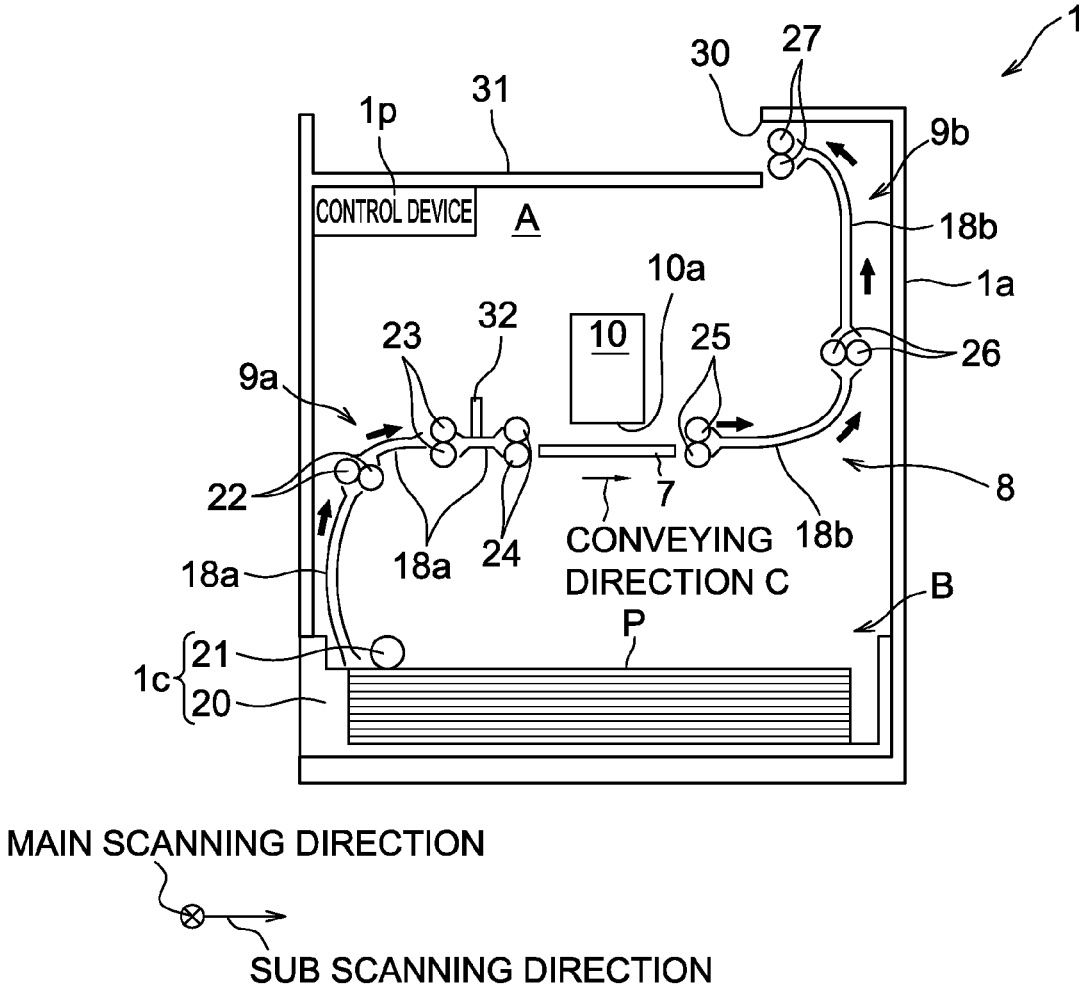
FIG. 1 is a schematic, cross-sectional view of an internal structure of an inkjet printer, according to an embodiment of the invention.

Referring to FIG. 1, a printer 1 (e.g., an inkjet printer) may comprise a rectangular housing 1*a*. A recording medium output unit 31 may be disposed above a top plate of the housing 1*a*. An inner cavity of the housing 1*a* may be divided into portions A and B, with portion A above portion B. A recording medium conveying path may be disposed in portions A and B, in the direction indicated by bold arrows in FIG. 1. A recording medium P may be conveyed along the recording medium conveying path from a recording medium feed unit 1*c* toward the recording medium output unit 31. In portion A, an image may be formed on the recording medium P, and the recording medium P may be conveyed to the recording medium output unit 31. In portion B, the recording medium P may be fed to the conveying path.

A recording medium sensor 32; an inkjet head 10, which discharges ink (hereinafter, "head 10"); a conveying mechanism 8; a platen (i.e., a facing unit) 7; a control device 1*p*; and other components may be disposed in portion A.

Figure 4:
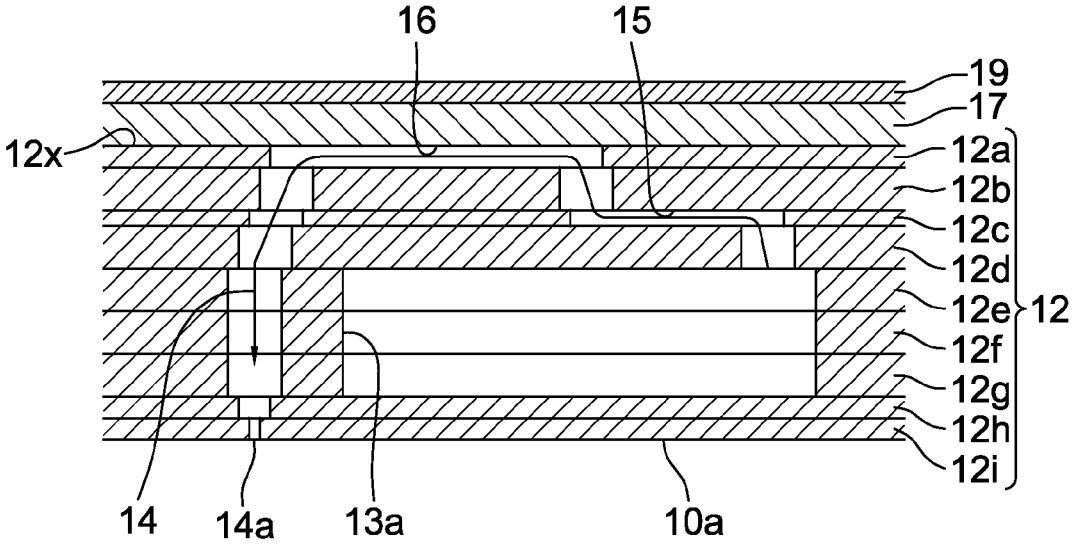
FIG. 4 is a partial sectional view along line IV-IV of FIG. 3.
Figure 4:
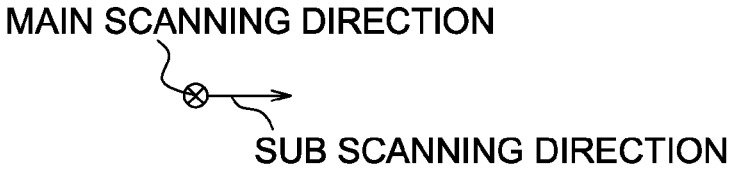

The head 10 may have a substantially rectangular shape, extending in a main scanning direction. The head 10 may be supported by a housing 1*a* via a frame (not depicted). The frame may support the head 10, so that a predetermined gap may be formed between the head 10 and the platen 7. As depicted in FIG. 4, a plurality of discharge ports 14*a*, which discharge the ink, may be disposed on a lower surface of the head 10 (i.e., a discharge surface 10*a*).

The recording medium sensor 32 may detect a front end of the conveyed recording medium P. A detection signal may be output to the control device 1*p*. Discharge timing for image formation may be determined in accordance with the receipt of the detection signal in the control device 1*p*.

The conveying mechanism 8 may comprise two guide units, 9*a* and 9*b*, that may guide the recording medium P. Each of the two guide units 9*a* and 9*b* may be placed on each side of the platen 7, respectively. The guide unit 9*a*, disposed upstream in the conveying direction, may comprise three guides 18*a* and three feed roller pairs 22 through 24. The guide unit 9*a* may be disposed between the recording medium feed unit 1*c* and the platen 7, so as to connect the recording medium feed unit 1*c* and the platen 7. The guide unit 9*a* may convey the recording medium P, on which an image is to be formed, toward the platen 7.

The guide unit 9*b*, disposed downstream in the conveying direction, may comprise two guides 18*b* and three feed roller pairs 25 through 27. The guide unit 9*b* may be disposed between the platen 7 and the recording medium output unit 31, so as to connect the platen 7 and the recording medium output unit 31. After an image is formed thereon, the recording medium P may be conveyed toward the recording medium output unit 31.

A recording medium feed unit 1*c* may be disposed in portion B. The recording medium feed unit 1*c* may comprise a recording medium feed tray 20 and a recording medium feed roller 21. The recording medium feed tray 20 may be attached to, or detached from, the housing 1*a*. The recording medium feed tray 20 may comprise a box structure with an upward opening and may be configured to receive a plurality of recording media P. The recording medium feed roller 21 may convey the uppermost recording medium P in the recording medium feed tray 20. The sub-scanning direction, along which the recording medium P may be conveyed by the feed roller pairs 24 and 25, may be parallel to the conveying direction C (i.e., the direction depicted by arrow C in FIG. 1). The main scanning direction may be perpendicular to the sub-scanning direction.

Figure 5:
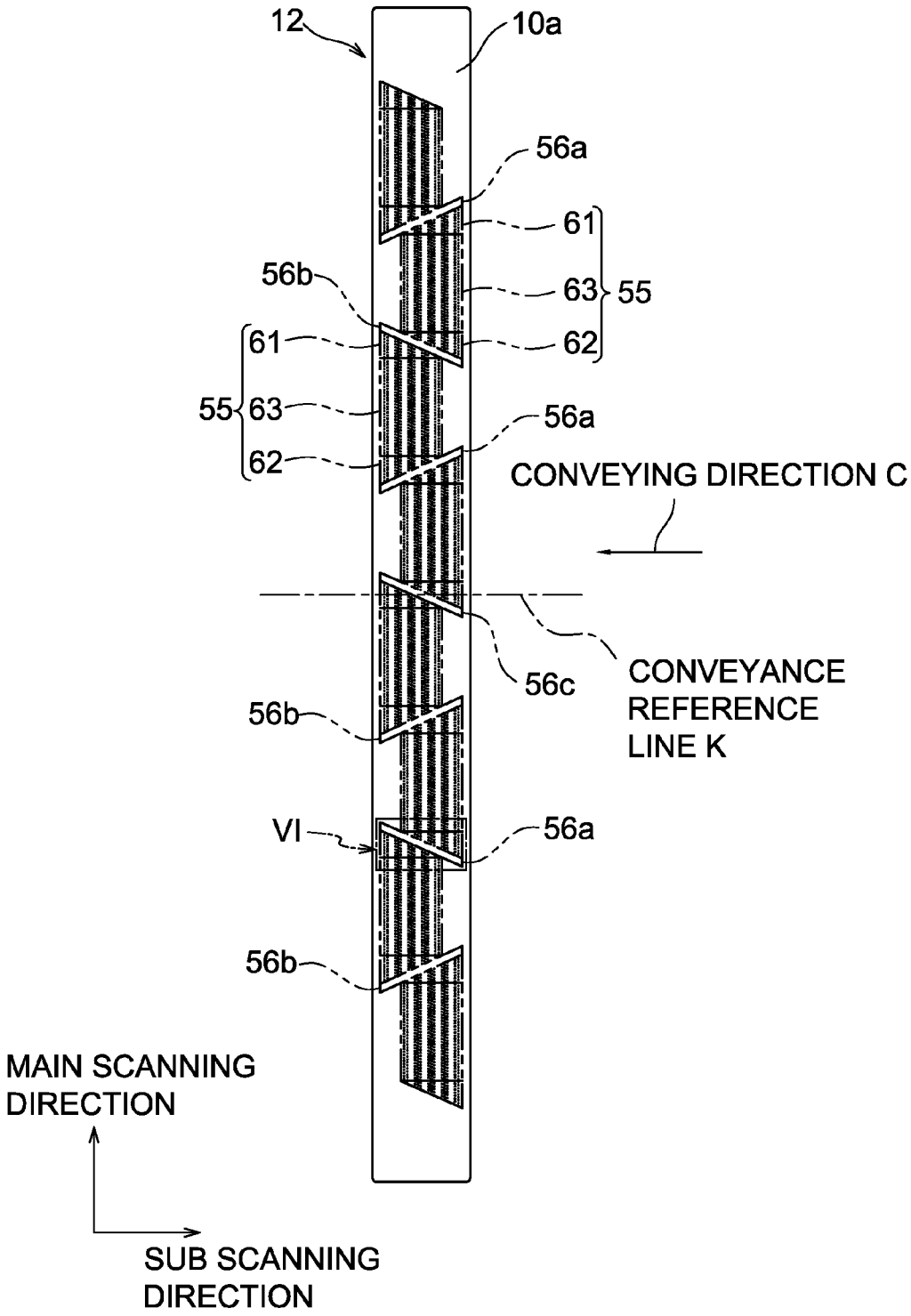
FIG. 5 is a plan view of the channel unit depicted in FIG. 2.

Each of a pair of movable guides, which may be movable in the main scanning direction, may be disposed on one of the sides of the recording medium feed tray 20 in the main scanning direction. The movable guides may be connected to each other, such that the guides move in synchronization. For example, when a first movable guide is moved a predetermined amount, to approach a second movable guide, the second movable guide also may be moved the predetermined amount, to approach the first movable guide. The recording medium P may be held by the movable guides, such that the center of the recording medium P aligns with the center of the recording medium feed tray 20 in the main scanning direction. Therefore, even if recording media of various sizes are placed in the recording medium feed tray 20, the center of the recording medium P in the main scanning direction may be maintained at the same position in the recording medium feed tray 20. In other words, the printer 1 may be configured to utilize a center reference system for the conveyance of the recording medium P. Each of a plurality of recording media P having various sizes may be conveyed according to the center reference system, when the recording medium P is conveyed to the guide unit 9*a*, from the recording medium feed unit 1*c* and when the recording medium P is conveyed to the platen 7, from the guide unit 9*a*. In the center reference system, a conveyance reference line K (i.e., a reference line) may extend along the center of the recording medium P in the main scanning direction (i.e., the center of the recording medium feed tray 20 in the main scanning direction). As depicted in FIG. 5, the conveyance reference line K may extend across the center of the discharge surface 10*a* in the main scanning direction.

An ink cartridge (not depicted), which stores ink to be supplied to the head 10, may be attachable to, and detachable from, the printer 1. The ink cartridge may be connected to the head 10 via a tube (not depicted) and may supply ink to the head 10.

The control device 1*p* may control operations of the printer 1 by controlling each component of the printer 1. The control device 1*p* may control an image formation operation in accordance with image data supplied from an external device (e.g., a PC connected to the printer 1). In particular, the control device 1*p* may control a preparatory operation for recording; operations for supplying, conveying, and outputting of the recording medium P; an ink discharge operation in synchronization with conveyance of the recording medium P; and other operations.

The control device 1*p* may be configured to drive a recording medium feed motor (not depicted) for the recording medium feed roller 21, feed motors (not depicted) for the feed roller pairs 22 through 27, and other components in accordance with instructions for recording, which may be received from the external device. The recording medium P conveyed from the recording medium feed tray 20 may be fed to the platen 7 by the upstream guide unit 9*a*. The recording medium P may be conveyed while being supported by the platen 7. Under the control of the control device 1*p*, ink may be discharged from the discharge ports 14*a* on the discharge surface 10*a*, and an image may be formed on the recording medium P, when the recording medium P passes immediately below the head 10 along the conveying direction C. The recording medium P, with the image formed thereon, may be output to the recording medium output unit 31 through an opening 30 disposed at an upper portion of the housing 1*a*, near the downstream guide unit 9*b*.

Figure 3:
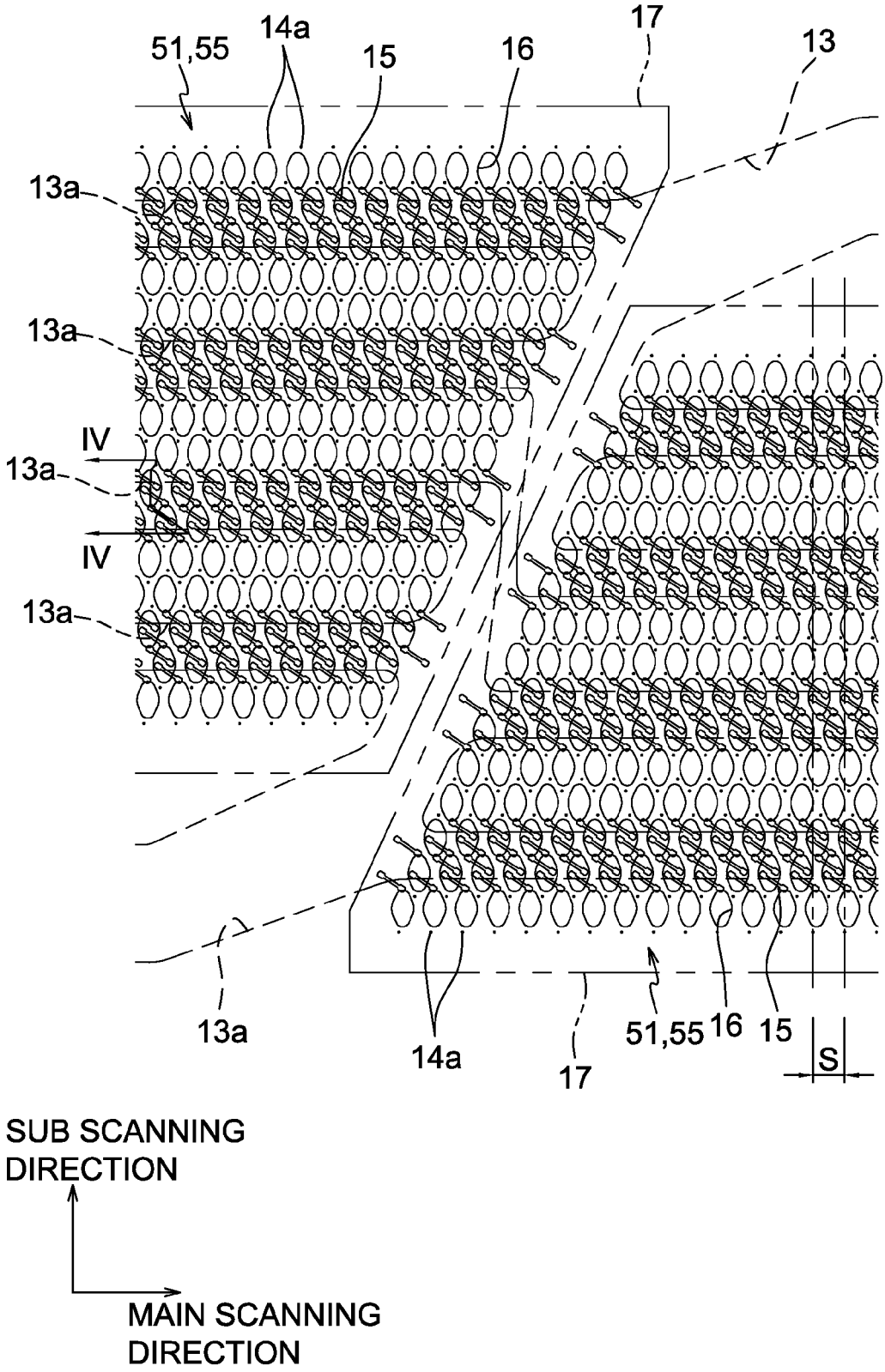
FIG. 3 is an enlarged view of an area identified by a dashed line and labeled III in FIG. 2.

As depicted in FIG. 3, pressure chambers 16 and apertures 15 may be disposed below actuator units 17. The head 10 may be a layered object that comprises a channel unit 12, eight actuator units 17, a reservoir unit (not depicted) and a circuit board (not depicted). An upstream ink channel comprising a reservoir may be disposed in the reservoir unit of an upstream channel member. Ink may be supplied to the reservoir unit from the ink cartridge. The reservoir may store the ink temporarily.

Figure 2:
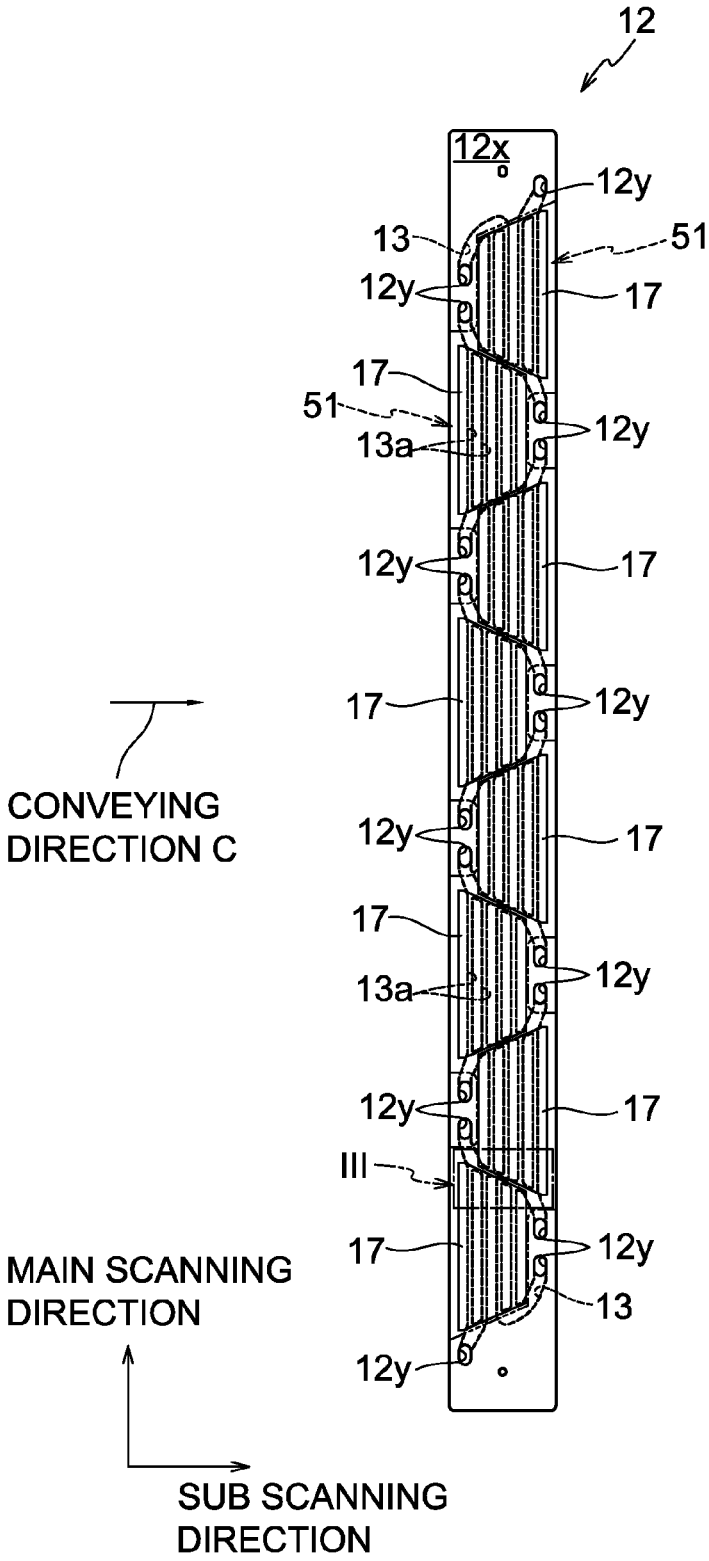
FIG. 2 is a plan view of a channel unit and an actuator unit of an inkjet head, as depicted in FIG. 1.

The channel unit 12 of a downstream channel member may be a layered object that comprises nine laminated, substantially rectangular metal plates 12*a* through 12*i*, as depicted in FIG. 4. A downstream ink channel may be disposed in the channel unit 12. The downstream ink channel may be connected to the upstream ink channel through an opening 12*y* on an upper surface 12*x*. As depicted in FIGS. 2 through 4, the downstream ink channel may comprise a manifold channel 13, a sub-manifold liquid path 13*a*, and a plurality of individual ink channels 14. One end of the manifold channel 13 may be the opening 12*y*. The sub-manifold liquid path 13*a* may branch from the manifold channel 13. The individual ink channels 14 may be connected to the sub-manifold liquid path 13*a*. Each of the individual ink channels 14 may comprise an aperture (i.e., a diaphragm) 15 for adjusting channel resistance and may extend from an outlet of the sub-manifold liquid path 13*a* to the discharge port 14*a* via a pressure chamber 16.

Eight pressure chamber groups 51, each of which corresponds to one of the trapezoidal actuator units 17, may be disposed on the upper surface 12*x* of the channel unit 12. As depicted in FIG. 3, each pressure chamber group 51 may be a collection of substantially oval-shaped pressure chambers 16, and a plurality of pressure chambers 16 may be arranged as a matrix in each pressure chamber group 51. Each pressure chamber group 51 may be disposed in a trapezoidal area that may be similar to an outer shape of the actuator unit 17. The pressure chamber group 51 may comprise sixteen pressure chamber arrays, in which the pressure chambers 16 are arranged along the main scanning direction. The plurality of the pressure chambers 16, which may constitute a single pressure chamber array, decreases from a greater length side (i.e., a lower bottom side) toward a lesser length side (i.e., an upper bottom side).

As depicted in FIG. 5, eight discharge portions 55 and seven non-discharge portions 56 may be disposed on a lower surface of the channel unit 12 (i.e., the discharge surface 10*a*). The discharge portions 55 may be disposed in an area that faces an area in which the actuator unit 17 is attached. Each of the non-discharge portions 56 may be disposed between two adjoining discharge portions 55. The eight discharge portions 55 may be arranged in an alternating pattern, corresponding to the pattern of the actuator units 17. Each of the discharge portions 55 may comprise a plurality of discharge ports 14*a*, arranged as a matrix, corresponding to the pressure chambers 16. In other words, each discharge portion 55 may be disposed in a trapezoidal area, which may be similar to an outer shape of the actuator unit 17, in the same manner as the pressure chamber group 51. The eight discharge portions 55 may be disposed, such that the eight trapezoidal areas formed by the discharge portions 55 are symmetrical about a point disposed substantially at the center of the discharge surface 10*a*. In addition, the discharge ports 14*a*, which may constitute the discharge portions 55, may be arranged symmetrically about the same point.

As depicted in FIG. 5, each discharge portion 55 may be divided into three portions: a rectangular portion 63 and two triangular portions 61 and 62, such that each of the triangular portions 61 and 62 may be disposed on each side of the rectangular portion 63. The rectangular portion 63 may be disposed so as to share a side of each of the triangular portions 61 and 62 in the sub-scanning direction (i.e., to form a trapezoid). The plurality of discharge ports 14*a* that are included in the rectangular portion 63 may be disposed at predetermined intervals along the main scanning direction with a center-to-center distance of about 42.3 micrometers (i.e., the distance equivalent to 600 dpi). The plurality of discharge ports 14*a*, which are included in the triangular portions 61 and 62, may be disposed at various intervals along the main scanning direction. Triangular portions 61 and 62, which are adjoined with a non-discharge portion 56 disposed therebetween, may be disposed, such that substantially the entire area of each is aligned in the main scanning direction on the discharge surface 10*a*.

Figure 6:
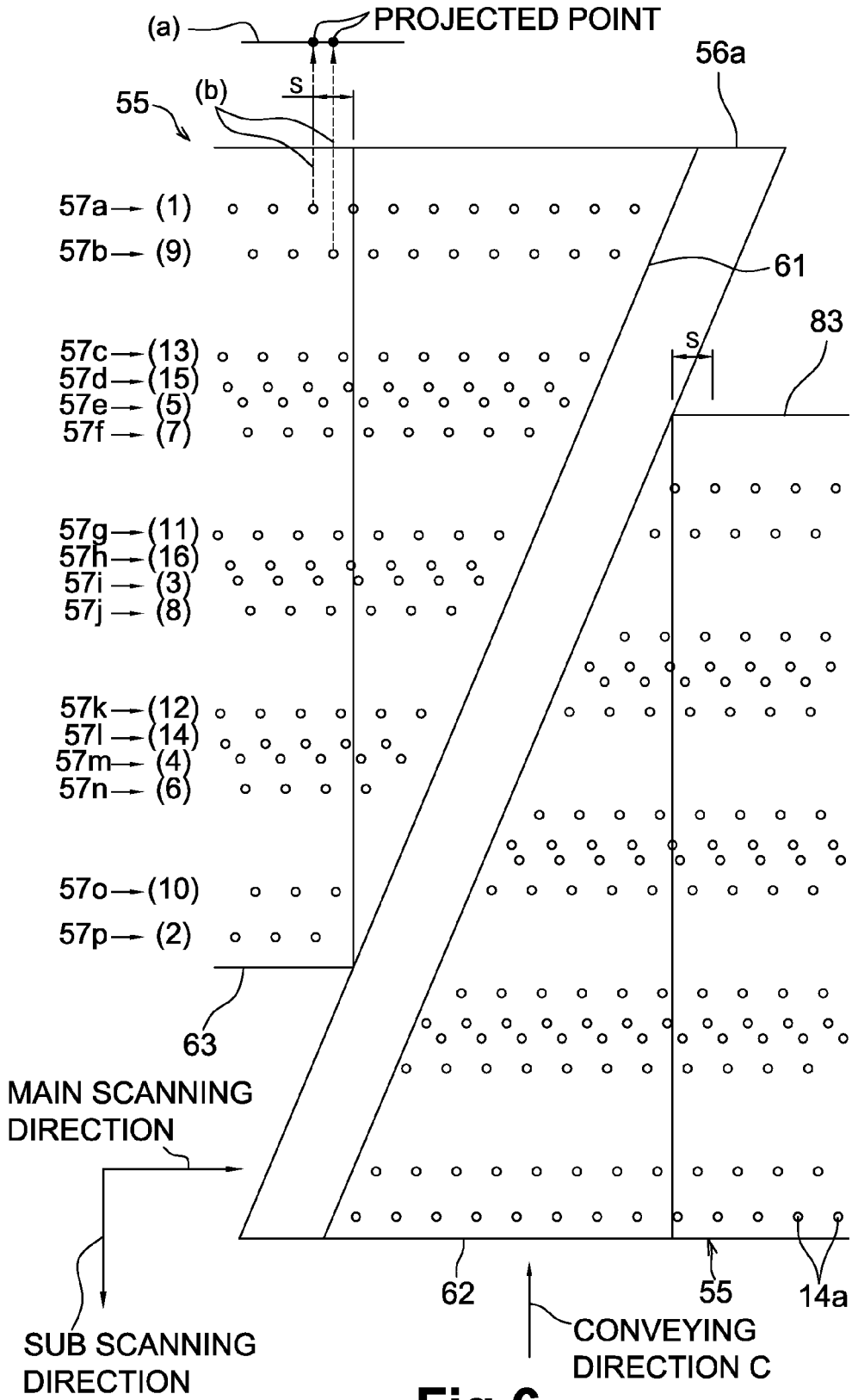
FIG. 6 is an enlarged view of an area identified by a dashed line and labeled VI in FIG. 5.

As depicted in FIG. 6, sixteen discharge port arrays 57, which may constitute each discharge portion 55, may be arranged parallel to one another in the main scanning direction. The plurality of discharge ports 14*a*, which may constitute each discharge port array 57, may be disposed along the main scanning direction with a center-to-center distance of about 677.3 micrometers (i.e., the distance equivalent to 37.5 dpi) in the same manner as in the arrangement of the pressure chambers 16.

As depicted in FIG. 3, each discharge port array 57 may be disposed bypassing each sub-manifold liquid path 13*a*. Each of a pair of discharge port arrays 57 may be disposed on one side of a single sub-manifold liquid path 13*a*.

As depicted in FIGS. 3 and 6, a strip-shaped portion S may have a width of 37.5 dpi in the main scanning direction, and the portion S may extend in the sub-scanning direction of the rectangular portion 63. In the rectangular portion 63 of the discharge portion 55, the strip-shaped portion S may comprise sixteen discharge ports 14*a*. Each of the sixteen discharge ports 14*a* may be associated with a different discharge port array 57. When each of the sixteen discharge ports 14*a* is projected on a straight line extending along the main scanning direction, the projected points may be disposed with a distance of 42.3 micrometers (i.e., distance equivalent to 600 dpi) between each point.

As depicted in FIG. 6, the projected points may be, for example, where straight lines that are parallel to the sub-scanning direction and that pass through the center of each discharge port 14*a* intersect with a straight line extending along the main scanning direction.

In one strip-shaped portion S, for example, the discharge port 14*a* projected at one end, e.g., the leftmost position, on the straight line extending along the sub-scanning direction may be numbered as "(1)" among the sixteen projected discharge ports 14*a*. The projected discharge ports 14*a* disposed along the straight line, e.g., to the right, in the sub-scanning direction, from the projected point (1) may be numbered consecutively as "(2)" through "(16)," designating their positions separated from the projected point (1). The sixteen discharge ports 14*a* may be arranged in the order of (1), (9), (13), (15), (5), (7), (11), (16), (3), (8), (12), (14), (4), (6), (10), and (2) in the sub-scanning direction, as depicted in FIG. 6. The sixteen discharge port arrays 57, which belong to each discharge portion 55, may be numbered as a first discharge port array 57*a*, a second discharge port array 57*b*, and subsequent discharge port arrays, through a sixteenth discharge port array 57*p*, in the sub-scanning direction, as depicted in FIG. 6. The discharge ports 14*a* may be disposed, such that the discharge port "(1)" corresponds to the discharge port array 57*a*, and the discharge port "(9)" corresponds to the discharge port array 57*b*, adjacent to the discharge port array 57*a*. Thus, the sixteen discharge ports 14*a* may be arranged in a staggered pattern in the main scanning direction.

The triangular portions 61 and 62, which are adjoined with a non-discharge portion 56 disposed therebetween, may be disposed, such that substantially the entire area of each are aligned in the main scanning direction, on the discharge surface 10*a*. In the aligned area, the discharge ports 14*a* may be arranged to be complementary with one another, so that printing may be continued at borders of the discharge portions 55. Within strip-shaped portions in the overlapping triangular portions 61 and 62, similar to those in the rectangular portion 63, the discharge ports 14*a* may have relative positional relationships with one another that are similar to those of the discharge ports 14*a* in the rectangular portion 63. All the discharge ports 14*a* may be arranged at regular intervals corresponding to the printing resolution in the main scanning direction.

Each of the non-discharge portions 56 may be in the shape of a parallelogram in plan view and may be disposed between two adjoining discharge portions 55 (i.e., adjoining triangular portions 61 and 62). No discharge port 14*a* may be disposed in the non-discharge portions 56. The non-discharge portions 56 may extend to intersect the main scanning direction and the sub-scanning direction (i.e., the conveying direction C) and may divide the plurality of discharge portions 55 in the main scanning direction on the discharge surface 10*a*. The width of each non-discharge portion 56 along the main scanning direction may be greater than the distance between two adjoining discharge ports 14*a* that comprise the discharge port array 57. Therefore, the distance in the sub-scanning direction between the discharge ports 14*a* of each of the two adjoining triangular portions 61 and 62 (i.e., the discharge portions 55), which adjoin each other in the main scanning direction, may be greater than the distance between the discharge ports 14*a* with corresponding positional relationships that comprise the rectangular portion 63.

As depicted in FIG. 5, the non-discharge portions 56 may comprise first non-discharge portions 56*a*, second non-discharge portions 56*b*, and a third non-discharge portion 56*c*. The first non-discharge portions 56*a* may extend to intersect the conveying direction C, so as to converge on the conveyance reference line K, from the upstream side toward the downstream side along the conveying direction of the recording medium P. The second non-discharge portions 56*b* may extend to intersect the conveying direction C, so as to diverge from the conveyance reference line K toward the downstream side in the conveying direction. The third non-discharge portion 56*c* may extend to intersect the conveying direction C and intersect the conveyance reference line K. Three first non-discharge portions 56*a*, two second non-discharge portions 56*b*, and one third non-discharge portion 56*c* may be disposed on the discharge surface 10*a*. Each second non-discharge portion 56*b* may be disposed between two discharge portions 55, which are different in combination from each of the two adjoining discharge portions 55 disposed on each side of the first non-discharge portion 56*a*. As described above, the conveyance reference line K may pass through center of the discharge surface 10*a* in the main scanning direction in plan view and may be parallel to the conveying direction C.

As depicted in FIG. 2, the actuator units 17 may be disposed along the main scanning direction, in an alternating pattern, on upper surface 12*x* of the channel unit 12. As depicted in FIG. 3, each actuator unit 17 may cover openings of the plurality of pressure chambers 16 disposed in an area in which the actuator unit 17 is attached. Each actuator unit 17 may be a layered object in which a piezoelectric layer (i.e., the uppermost layer), polarized in the thickness direction, may be laminated on a vibrating plate. The vibrating plate may also be a piezoelectric layer that does not perform spontaneous deformation. The uppermost layer may be disposed between a plurality of individual electrodes on the front side and a common electrode on the inner side. When a portion between an individual electrode and the common electrode is distorted, the portion undergoes unimorph deformation with the vibrating plate. The portion that undergoes unimorph deformation (i.e., the portion between the individual electrode and pressure chambers) may operate as an individual actuator, which may be driven selectively by a driving signal.

A flexible printed circuit (FPC) 19 may have wiring corresponding to each of the electrodes of the actuator units 17; and a driver IC (not depicted) may be mounted on an intermediate portion of the wiring. One end of the FPC 19 may be fixed to the actuator unit 17 and another end of the FPC 19 may be fixed to a control substrate (not depicted) of the head 10, which is disposed above the reservoir unit. Under the control of the control device 1*p*, the FPC 19 may transmit various signals (e.g., control signals and image signals) output from the control substrate to the driver IC, and the FPC 19 may transmit driving signals generated by the driver IC to a corresponding individual actuator.

Figure 7A:
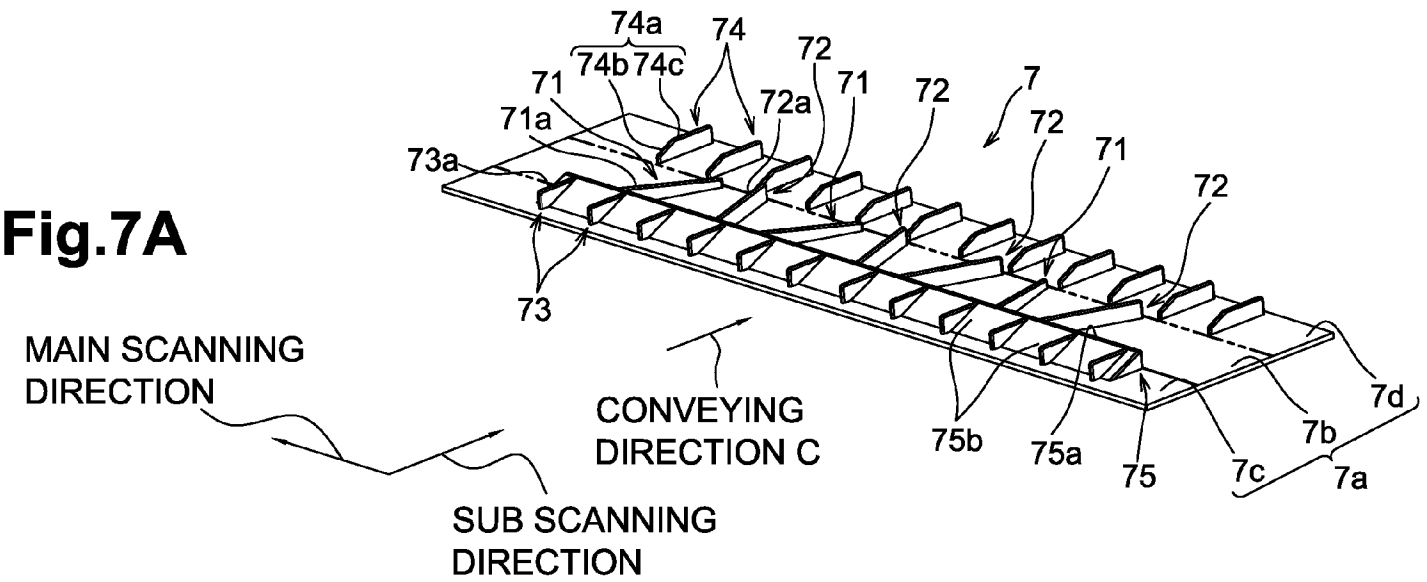
FIG. 7A is a perspective view of a platen depicted in FIG. 1.
Figure 7B:
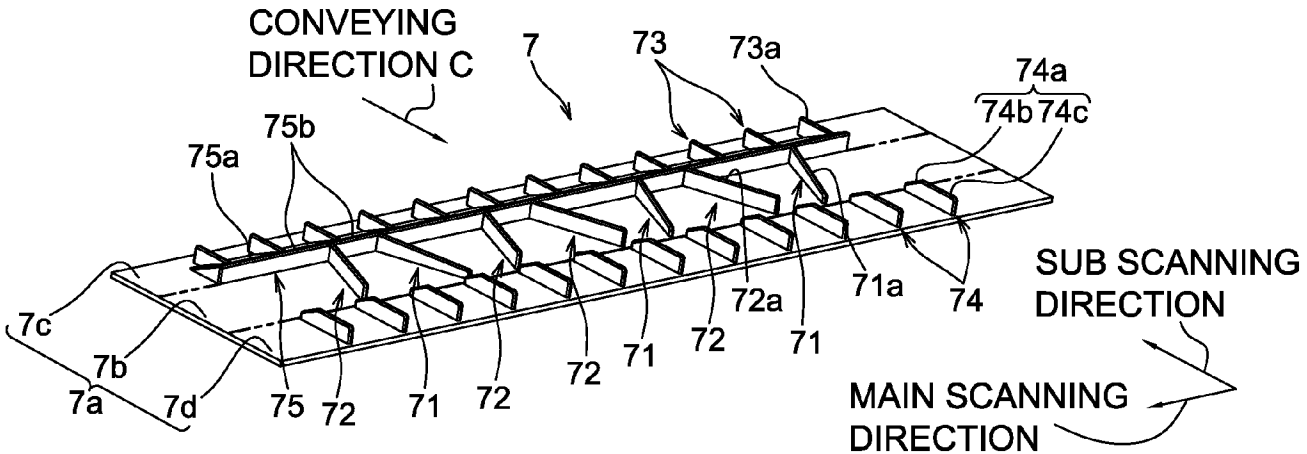
FIG. 7B is another perspective view of the platen depicted in FIG. 1.
Figure 8:
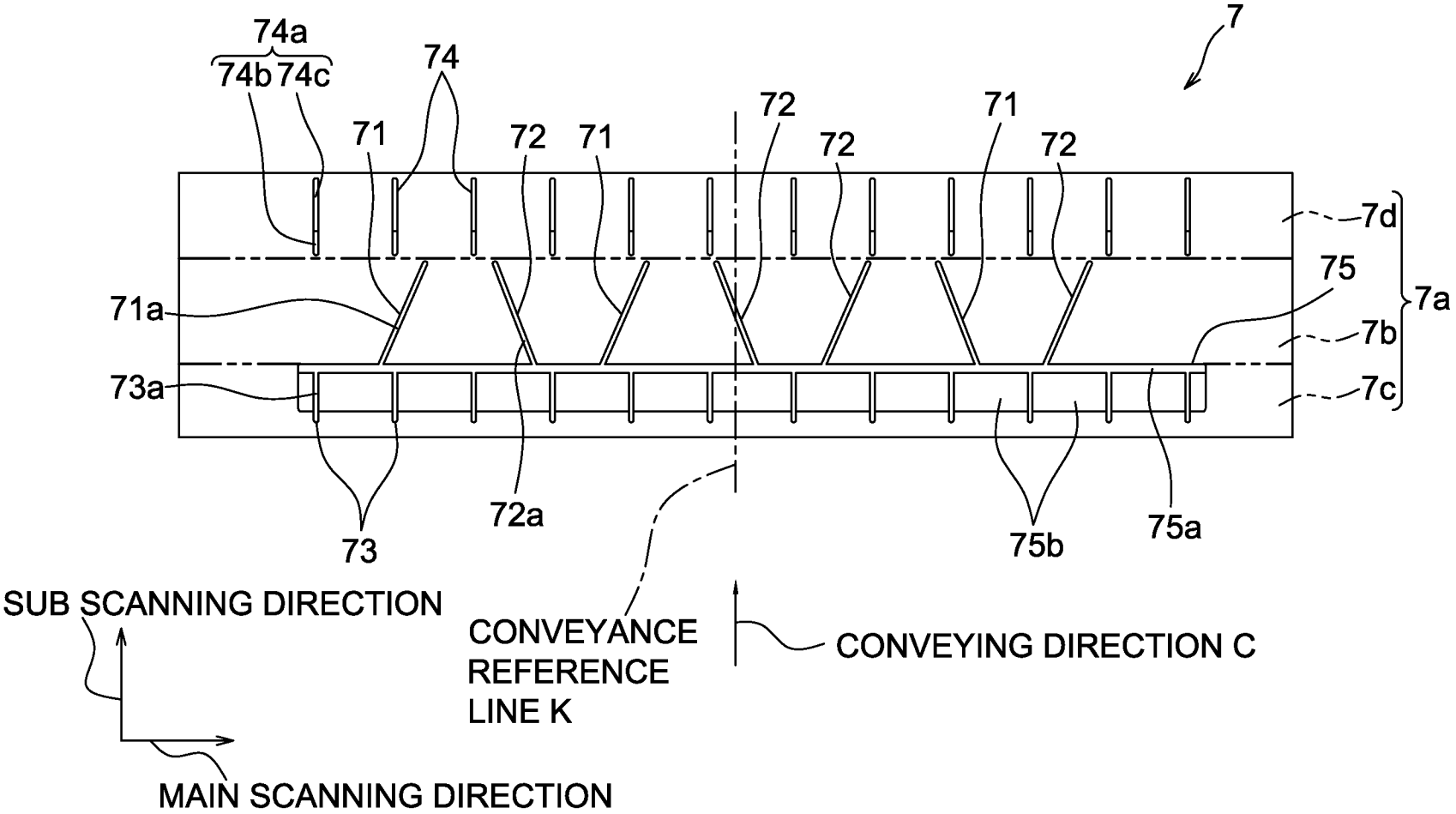
FIG. 8 is a plan view of the platen depicted in FIG. 1.

Referring to FIGS. 7 and 8, the platen 7 may comprise a rectangular, upper surface 7*a* and a plurality of projections. The upper surface 7*a* may be slightly larger than the discharge surface 10*a*. The plurality of projections may be disposed on the upper surface 7*a*. The plurality of projections may comprise first projections 71, second projections 72, upstream projections 73, downstream projections 74, and a connecting projection 75. The upper surface 7*a* may comprise a central portion 7*b*, an upstream portion 7*c*, and a downstream portion 7*d*. The central portion 7*b* may face the discharge surface 10*a*. The upstream portion 7*c* may be disposed upstream of the central portion 7*b* in the conveying direction. The downstream portion 7*d* may be disposed downstream of the central portion 7*b* in the conveying direction.

As depicted in FIGS. 7 and 8, three first projections 71 may be disposed along the main scanning direction in the central portion 7*b* of the upper surface 7*a*. The first projections 71 may be disposed in the central portion 7*b* in an area that faces the first non-discharge portion 56*a*, and may extend along the extending direction of the first non-discharge portion 56*a* that faces the first projections 71. Upper portions (i.e., top portions) 71*a* of the first projections 71 may be sloped, such that the distance from the discharge surface 10*a* increases toward the downstream side in the conveying direction. Each of the first projections 71 may comprise two side surfaces that are connected to the top portion 71*a* and extend in the extending direction. These two side surfaces may be defined by planes.

Four second projections 72 may be disposed in the central portion 7*b* of the upper surface 7*a*, along the main scanning direction. Among the four second projections 72, three second projections 72 may be disposed in the central portion 7*b*, in an area that faces the second non-discharge portion 56*b*, and may extend along the extending direction of the second non-discharge portion 56*b* that faces the three second projections 72. The remaining second projection(s) 72 may be disposed in the central portion 7*b* in an area that faces the third non-discharge portion 56*c* and may extend in the extending direction of the third non-discharge portion 56*c* that faces the second projection 72. Upper portions (i.e., top portions) 72*a* of the second projections 72 may be parallel to the discharge surface 10*a*. The upper portions 72*a* may be substantially the same height as the upstream ends of the upper portions 71*a* of the first projections 71.

Twelve upstream projections 73 may be disposed in the upstream portion 7*c* of the upper surface 7*a*. These upstream projections 73 may extend along the conveying direction C and may be separated from one another along the main scanning direction. Upper portions (i.e., top portions) 73*a* of the upstream projections 73 may be parallel to the discharge surface 10*a*. The upper portions 73*a* may be substantially the same height as the upstream ends of the upper portions 71*a* of the first projections 71 and as the upstream ends of the upper portions 72*a* of the second projections 72. These upstream projections 73 may allow the conveyed recording medium P to be supported at the height of the first and second projections 71 and 72. Therefore, a front end of the recording medium P is less likely to be caught by the first and second projections 71 and 72.

The connecting projection 75 may be disposed at a position further upward than the first projections 71 and the second projections 72 and in the upstream portion 7*c* of the upper surface 7*a*. The connecting projection 75 may extend along the main scanning direction and may be connected to the downstream ends of the upstream projections 73 and to the upstream ends of the first and second projections 71 and 72. An upper portion (i.e., a top portion) 75*a* of the connecting projection 75 may be disposed in the same manner as those of the upper portions 73*a* of the upstream projections 73. An upstream side surface 75*b* of the connecting projection 75 (i.e., portions of the connecting projection 75 disposed between the upstream projections 73) may be sloped. Even if the recording medium P is conveyed with its front end corner (i.e., a downstream end corner in the conveying direction) disposed between the upstream projections 73, the connecting projection 75 may allow the front end corner to be lifted by the side surface (i.e., the slope) 75*b* of the connecting projection 75 toward the discharge surface 10*a*. Thus, the recording medium P is less likely to be caught by the first projections 71. Upper portions 73*a* of the upstream projections 73 and the upper portion of the connecting projection 75 may have a greater height than the upper portions 71*a* of the first projections 71.

Alternatively, not only the side surface 75*b*, but also the entire body of the connecting projection, may be disposed between the adjoining upstream projections 73. In other words, the connecting projection may connect portions other than the downstream ends of the upstream projections 73.

Twelve downstream projections 74 may be disposed in the downstream portion 7*d* of the upper surface 7*a*. These downstream projections 74 may extend along the conveying direction C and may be separated from one another along the main scanning direction. The downstream projections 74 may be disposed at positions overlapping the upstream projections 73 along the sub-scanning direction. The upstream ends of the downstream projections 74 may be disposed near the downstream ends of the first and second projections 71 and 72 in the sub-scanning direction. Each of upper portions (i.e., top portions) 74*a* of the downstream projections 74 may comprise a sloped portion 74*b* and a horizontal portion 74*c*. The sloped portion 74*b* may be sloped, such that the distance from the discharge surface 10*a* decreases toward the downstream side in the conveying direction. The horizontal portion 74*c* may be parallel to the discharge surface 10*a* and may be substantially the same height as the upper portions 72*a* of the second projections 72. The sloped portion 74*b* may be disposed between an upstream end and an intermediate portion of the upper portion 74*a* along the conveying direction C. The horizontal portion 74*c* may be disposed between a downstream end of the sloped portion 74*b* and a downstream end of the upper portion 74*a*. The upstream ends of the sloped portions 74*b* may be lower than the height of the downstream ends of the first projections 71. Alternatively, the upstream ends of the sloped portions 74*b* may be substantially the same height as the downstream ends of the first projections 71. Therefore, the front end of the recording medium P conveyed over the first projections 71 is less likely to be caught by the sloped portions 74*b* of the downstream projections 74. In addition, the horizontal portions 74*c* of the upper portions 74*a* may allow a portion of the recording medium P conveyed past the sloped portions 74*b* to be supported parallel to the discharge surface 10*a*. Therefore, it may be possible to support the recording medium P on the platen 7 in order to maintain the distance between a portion of the recording medium P upstream of the downstream projections 74 and the discharge surface 10*a*.

Figure 9A:
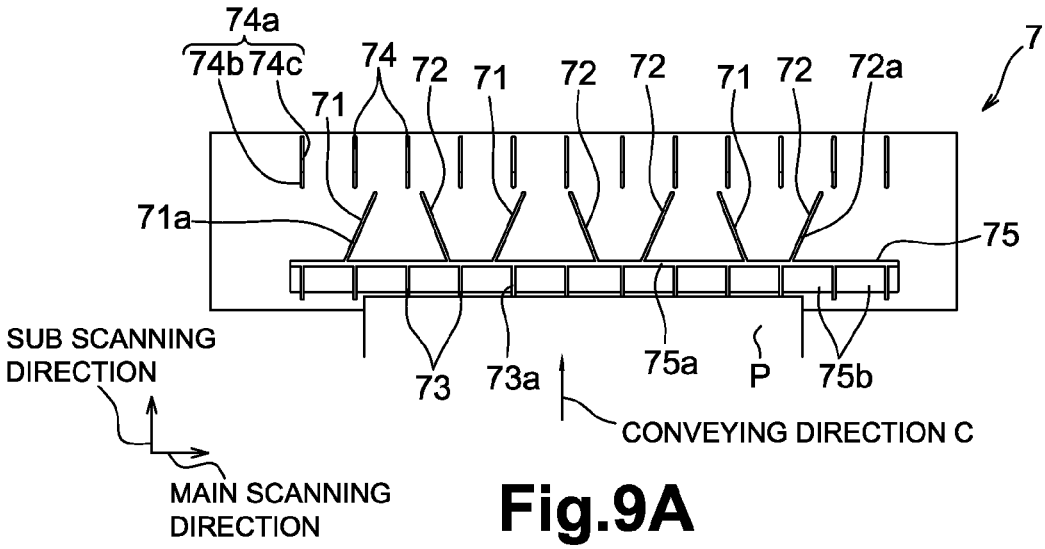
FIGS. 9A, 9B, and 9C depict a recording medium conveyed on the platen.
Figure 9B:
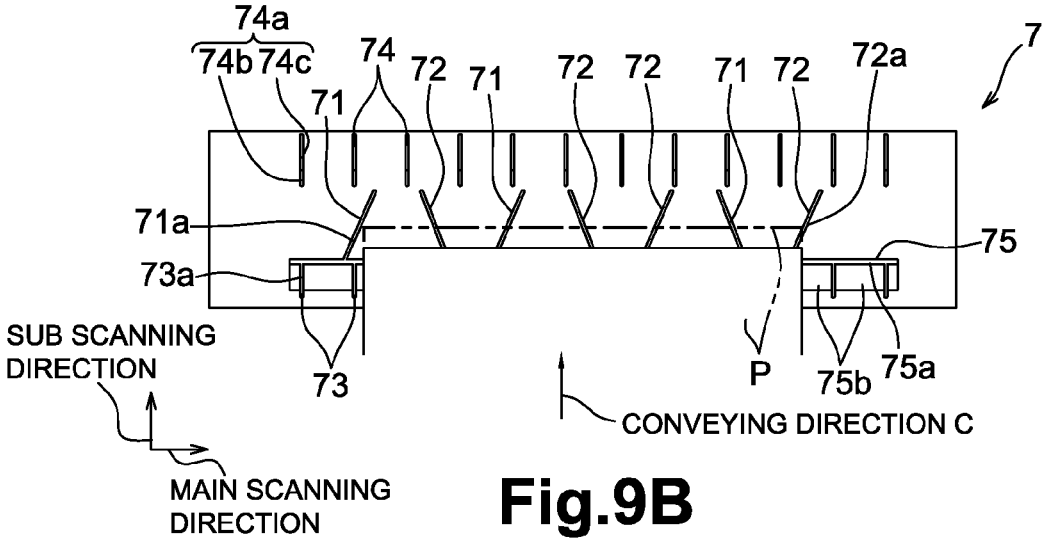
Figure 9C:
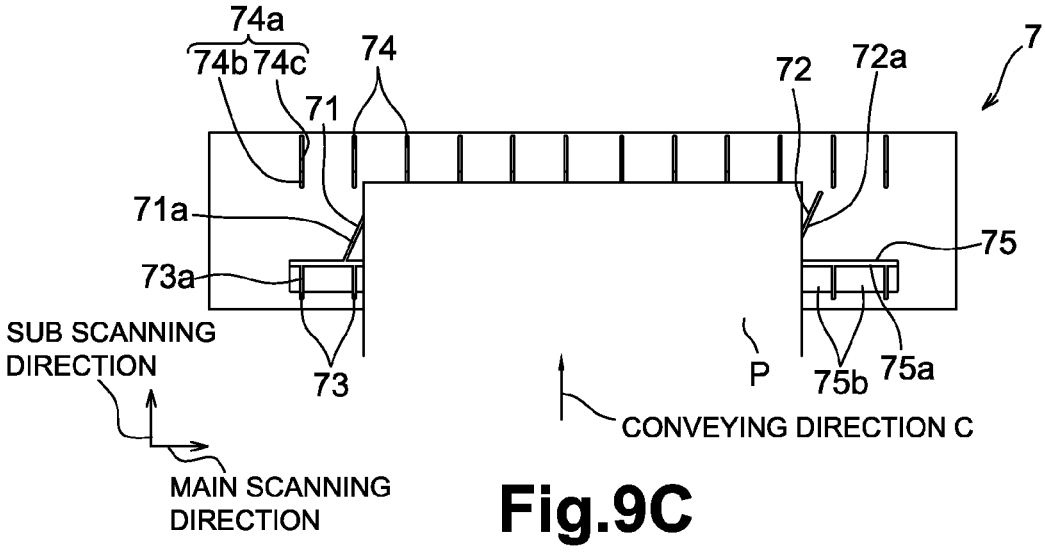

Referring to FIGS. 9A through 9C, as a recording medium P of predetermined size is conveyed onto the platen 7 by the guide unit 9*a*, the front end of the recording medium P may be supported by the eight upstream projections 73, as depicted in FIG. 9A. The recording medium P may be conveyed in the center reference system and the front end corners of the recording medium P may be positioned between two adjoining upstream projections 73. Even if the front end corners of the recording medium P are bent further downward than the upper portion 73*a*, the sloped side surface 75*b* of the connecting projection 75 may lift the recording medium P as the recording medium P is conveyed along the conveying direction C. If the front end of the recording medium P is bent downward between the upstream projections 73, the side surface 75*b* may lift the recording medium P in the same manner described above. Thus, immediately before the front end of the recording medium P faces the discharge surface 10*a*, the entire front end of the recording medium P may be supported substantially at the same height as the upstream ends of the first projections 71 and the second projections 72. Therefore, even if the recording medium P is conveyed with the front end corner disposed between the upstream projections 73, the front end of the recording medium P is less likely to be caught by the first and second projections 71 and 72.

As the recording medium P is conveyed to a position that faces the discharge surface 10*a*, a front right corner of the recording medium P may be conveyed over the second projections 72, as depicted in FIG. 9B. The upstream ends of the second projections 72 may support the recording medium P at a position closer to the center of the recording medium P than the front right corner of the recording medium P in the main scanning direction. Therefore, as depicted by the broken line in FIG. 9B, the portion of the recording medium P supported by the upper portions 72*a* of the second projections 72 may approach the front end corner as the front right corner of the recording medium P approaches the second projections 72. Because the front right corner of the recording medium P may not easily bend further downward than the upper portions 72*a*, the front right corner of the recording medium P is less likely to be caught by the side surfaces of the second projections 72.

A front left corner of the recording medium P may be conveyed over the first projections 71. Because a portion near the front left corner of the recording medium P may not be supported by the first projections 71 and the second projections 72 when the front left corner approaches the first projections 71, as depicted by the broken line in FIG. 9B, the front left corner may easily bend further downward than the upper portions 73*a*. Nevertheless, the upper portions 71*a* of the first projections 71 may be sloped inward toward the conveying direction C; therefore, even if the front left corner of the recording medium P is bent downward, the front left corner of the recording medium P is less likely to be caught by the first projections 71 and may be conveyed over the first projections 71.

After the front end of the recording medium P is conveyed through the portion that faces the discharge surface 10*a*, the front end of the recording medium P may be supported by the eight downstream projections 74, as depicted in FIG. 9C. Because the height of the upstream ends of the downstream projections 74 may be less than the height of the downstream ends of the first projections 71, even if the front end corners of the recording medium P and the portion of the front end of the recording medium P between the second projections 72 is bent downward, the front end may not be caught by the upstream ends of the downstream projections 74 and may be lifted by the sloped portions 74*b* while conveyed along the conveying direction C, as depicted in FIG. 9C. Thus, the recording medium P may be conveyed over the platen 7, such that the entire front end of the recording medium P may be supported at substantially the same height as the upstream ends of the first projections 71 and the second projections 72. Even if the size of the recording medium P is less than that depicted in FIGS. 9A through 9C, or even if the recording medium P is conveyed in a misaligned manner in the main scanning direction and, for example, the front right corner is conveyed over the first projections 71, the recording medium P may be conveyed without being caught by the upstream projections 73 in the same manner as described above with regard to the front end left corner of the recording medium P.

Therefore, in the printer 1, even if, for example, jamming of the recording medium P occurs upstream of the platen 7, in the conveying direction, and ink is discharged from the discharge portion 55 of the head 10 toward the platen 7, ink may not adhere to the upper portions 71*a* and 72*a* of the projections 71 and 72, but rather adheres to the upper surface 7*a*, because the first and second projections 71 and 72 face the non-discharge portions 56. Ink adhering to the upper surface 7*a* may not adhere to the recording medium P because the recording medium P conveyed on the platen 7 may be supported by the first and second projections 71 and 72, and other components. Because the upper portions 71*a* of the first projections 71 are sloped, the front end corner of the recording medium P, which may be conveyed between the discharge surface 10*a* and the platen 7, is less likely to be caught by the first projections 71. Therefore, jamming of the recording medium P between the discharge surface 10*a* and the platen 7 is less likely to occur. Further, the recording medium P may be prevented from contacting the discharge surface 10*a*. Thus, adhesion of ink to the recording medium P, jamming of the recording medium P, and the recording medium P contacting the discharge surface 10*a* may be reduced or prevented.

The second projections 72, comprising upper portions 72*a* that may be parallel to the discharge surface 10*a*, may be disposed on the platen 7 in the area that faces the discharge surface 10*a*; thus, the distance between the recording medium P and the discharge surface 10*a* may be maintained. The upstream ends of the upper portions 71*a* of the first projections 71 and the upper portions 72*a* of the second projections 72 may be substantially the same height; thus, the recording medium P may be supported by a greater number of components that are substantially the same in height, and the distance between the recording medium P and the discharge surface 10*a* may be maintained. The first projections 71 may be disposed between the second projections 72; thus, even if the recording medium P is bent between the second projections 72, the bent portion may be supported and the recording medium P may be prevented from contacting the upper surface 7*a*.

Figure 10A:
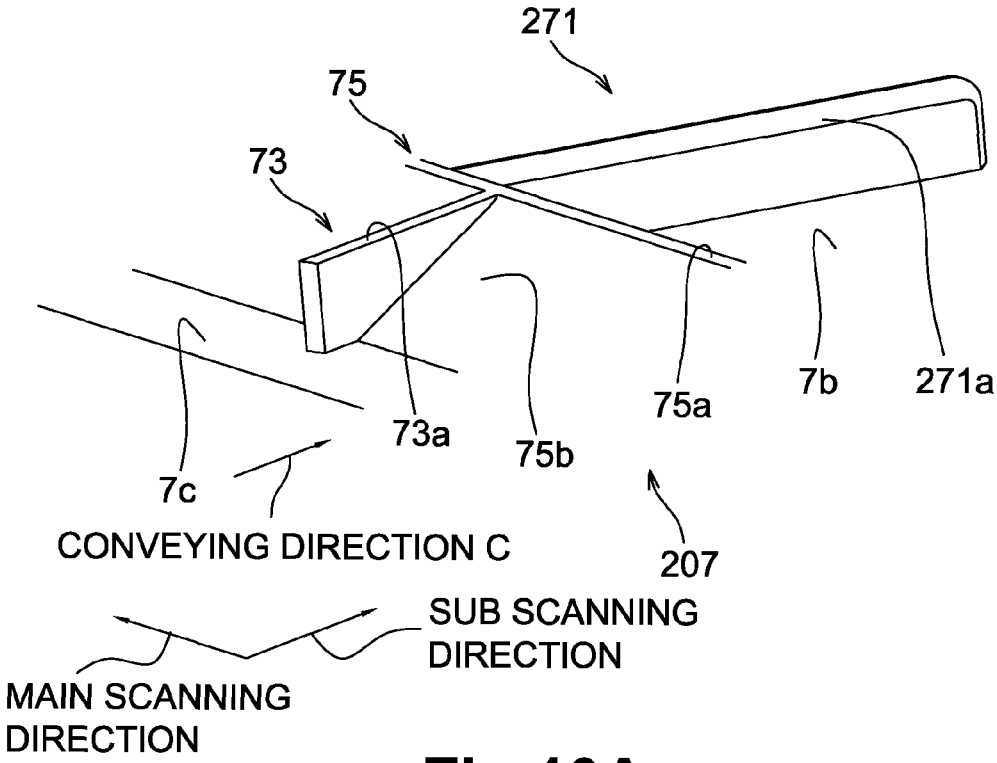
FIG. 10A is a perspective view of a portion of the platen according to another embodiment of the invention.
Figure 10B:
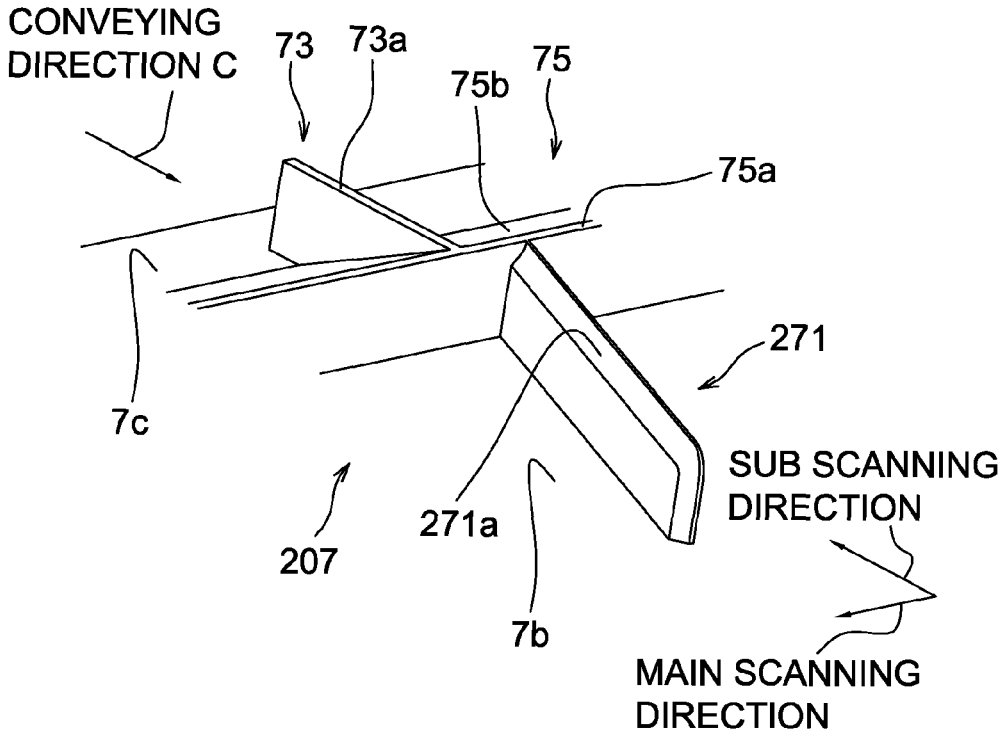
FIG. 10B is another perspective view of a portion of the platen according to the another embodiment of the invention.

Referring to FIG. 10, the structure of the printer 1 according to another embodiment may be similar to that of the first embodiment, except that a structure of a platen 207 may differ from that of the platen 7 of the first embodiment. Components similar to those of the first embodiment are denoted by the same reference numerals and descriptions thereof are omitted here.

The platen 207 may be similar to platen 7, except that the configuration of the first projections 271 may differ from that of the first projections 71. As depicted in FIG. 10, upper portions (i.e., top portions) 271*a* of the first projections 271 may be sloped. In particular, the distance between the upper portions 271*a* and the discharge surface 10*a* may increase toward the conveyance reference line K in the width direction, perpendicular to the direction in which the first projections 271 extend.

Because the upper portions 271*a* are sloped, even if the recording medium P is conveyed with the front end corner thereof passing over the first projections 271, the front end corner, which may be bent downward, may be lifted by the upper portions 271*a* during the conveyance along the conveying direction C. Therefore, the front end corner of the recording medium P may not be caught by the first projections 271, and the recording medium P may be conveyed more smoothly. Thus, jamming of the recording medium P between the discharge surface 10*a* and the platen 207 is less likely to occur. The components that are configured similar to those of the first embodiment may provide the same effects as those of the first embodiment.

Although embodiments of the invention have been described above, the invention is not limited to the above-described embodiments. Various changes may be made without departing from the scope of the invention. For example, although the recording medium P is described as being conveyed in the center reference system, the recording medium P also may be conveyed in a side reference system. In particular, one end of the recording medium P, in the direction perpendicular to the conveying direction C, may be used as a reference. In this case, the recording medium feed tray may comprise a movable guide at one main scanning direction side thereof and a fixed guide at the other main scanning direction side. The recording medium P may be disposed between the movable guide and the fixed guide, such that one end of the recording medium P may be aligned at the other main scanning direction side. Therefore, if recording media P of varying size are disposed in the recording medium feed tray 20, one end, in the main scanning direction, of each of the recording media P may be disposed at the same position in the recording medium feed tray 20. In this case, the conveyance reference line, along the sheet conveying direction, may pass through the one end in the main scanning direction of the recording medium P. On discharge surface 10*a*, among the plurality of non-discharge portions 56, portions extending to intersect the conveying direction C, such that the portions converge on the conveyance reference line K from the upstream side toward the downstream side along the conveying direction of the recording medium P, may be first non-discharge portions. Portions extending to intersect the conveying direction C, such that the portions diverge from the conveyance reference line K, may be second non-discharge portions. Among a plurality of projections disposed in the central portion 7*b* of the platen 207, projections that face the first non-discharge portions may be first projections and projections that face the second non-discharge portions may be second projections. Because the first and second projections have sloped configurations similar to those of the first and second embodiments, the same effects may be provided. In this embodiment, a non-discharge portion that intersects the conveyance reference line K in plan view may be a third non-discharge portion, and projections that face the third non-discharge portion may be the second projections.

In an embodiment, no second projection 72 may be disposed on the platen, and neither the second non-discharge portion 56*b* nor the third non-discharge portion 56*c* may be disposed on the discharge surface 10*a*. Any or all of the upstream projections 73, the connecting projection 75, and downstream projections 74 may be omitted from the platen. In other words, only the first projections 71 and 271 may be disposed on the platen. If the printer 1 conveys a single size of recording media P (i.e., does not convey recording media P of various sizes), not all of the first projections 71 and 271 may be sloped. In other words, only the first projections 71 and 271 that the front end corner of the recording medium P reaches during conveyance may comprise sloped portions.

The invention is not limited to a printer, but may be applied to other apparatus, such as facsimile machines and copiers, and also may be applied to a liquid discharge apparatus that records an image by discharging liquids other than ink. The recording medium is not limited to the recording medium P, but may be various media adapted for recording.

While the invention has been described in connection with various exemplary structures and illustrative embodiments, it will be understood by those skilled in the art that other variations and modifications of the structures, configurations, and embodiments described above may be made without departing from the scope of the invention. For example, this application may comprise any possible combination of the various elements and features disclosed herein, and the particular elements and features presented in the claims and disclosed above may be combined with each other in other ways within the scope of the application, such that the application should be recognized as also directed to other embodiments comprising any other possible combinations. Other structures, configurations, and embodiments will be apparent to those skilled in the art from a consideration of the specification or the practice of the invention disclosed herein. It is intended that the specification and the described examples may be illustrative of embodiments of the invention, with the true scope of the invention being defined by the following claims.

What is claimed is:

1. A liquid discharge apparatus comprising:

a conveyer configured to convey a recording medium in a conveying direction parallel to a reference line;

a liquid discharge head comprising:

a discharge surface comprising:

a plurality of discharge portions, wherein each of the plurality of discharge portions comprises a plurality of discharge ports from which liquid is discharged; and a particular non-discharge portion disposed between two adjoining discharge portions, and extending to converge on the reference line from an upstream side toward a downstream side in the conveying direction; and a supporter comprising:

a projection comprising:

a particular top portion facing the particular non-discharge portion and extending along the non-discharge portion, wherein the particular top portion is configured to support the recording medium conveyed by the conveyer, and wherein the particular top portion is sloped, such that a distance between the particular top portion and the discharge surface increases from the upstream side toward the downstream side in the conveying direction.

2. The liquid discharge apparatus according to claim 1, wherein the discharge surface comprises three or more discharge portions and further comprises a further non-discharge portion, wherein the further non-discharge portion is disposed between two adjoining discharge portions, at least one of which is different from the two adjoining discharge portions that define the particular non-discharge portion, and the further non-discharge portion extends, such that it diverges from the reference line from the upstream side toward the downstream side in the conveying direction;

wherein the supporter further comprises a further projection comprising a further top portion facing the further non-discharge portion and extending along the further non-discharge portion, wherein the further top portion is configured to support the recording medium conveyed by the conveyer, and wherein the further top portion is parallel to the discharge surface.

3. The liquid discharge apparatus according to claim 2, wherein an upstream end, in the conveying direction, of the particular top portion has substantially a same height as the further top portion.

4. The liquid discharge apparatus according to claim 1, wherein the supporter further comprises an upstream projection disposed upstream of the particular projection in the conveying direction, wherein the upstream projection comprises an upstream top portion extending in the conveying direction, wherein the upstream top portion is configured to support the recording medium conveyed by the conveyer, and wherein the upstream top portion is parallel to the discharge surface.

5. The liquid discharge apparatus according to claim 4, wherein the upstream top portion is not lower than an upstream end, in the conveying direction, of the particular top portion.

6. The liquid discharge apparatus according to claim 4, wherein the upstream projection comprises a plurality of upstream projections, and wherein each of the plurality of upstream projections is arranged in the direction perpendicular to the conveying direction.

7. The liquid discharge apparatus according to claim 4, wherein the upstream projection comprises a plurality of upstream projections, wherein the supporter further comprises a connecting projection comprising a connecting top portion extending along the direction perpendicular to the conveying direction and connecting the plurality of upstream projections, wherein the connecting top portion is configured to support the recording medium conveyed by the conveyer, and wherein the connecting top portion is parallel to the discharge surface.

8. The liquid discharge apparatus according to claim 7, wherein the connecting top portion is not lower than the upstream end, in the conveying direction, of the particular top portion.

9. The liquid discharge apparatus according to claim 1, wherein the supporter further comprises a downstream projection disposed downstream of the particular projection in the conveying direction, and wherein the downstream projection comprises a downstream top portion extending in the conveying direction, wherein the downstream top portion is configured to support the recording medium conveyed by the conveyer, and wherein an upstream side, in the conveying direction, of the downstream top portion is sloped such that a distance between the downstream top portion and the discharge surface decreases from the upstream side toward the downstream side in the conveying direction.

10. The liquid discharge apparatus according to claim 9, wherein the downstream projection comprises a plurality of downstream projections, and wherein each of the plurality of downstream projections is arranged in the direction perpendicular to the conveying direction.

11. The liquid discharge apparatus according to claim 9, wherein a height of an upstream end in the conveying direction of the downstream top portion is less than or equal to a height of a downstream end in the conveying direction of the particular top portion.

12. The liquid discharge apparatus according to claim 9, wherein a downstream side, in the conveying direction, of the downstream top portion is parallel to the discharge surface.

13. The liquid discharge apparatus according to claim 12, wherein the downstream side of the downstream top portion is substantially the same height as an upstream end, in the conveying direction, of the particular top portion.

14. The liquid discharge apparatus according to claim 1, wherein the conveyer is configured to convey the recording medium such that the reference line extends along at least one of a center and a side of the recording medium in the direction perpendicular to the conveying direction.

15. A liquid discharge apparatus comprising:

a conveyer configured to convey a recording medium in a conveying direction parallel to a reference line;

a liquid discharge head comprising:

a discharge surface comprising:

a plurality of discharge portions, wherein each of the plurality of discharge portions comprises a plurality of discharge ports from which liquid is discharged; and a particular non-discharge portion disposed between two adjoining discharge portions, and extending to converge on the reference line from an upstream side toward a downstream side in the conveying direction; and a supporter comprising:

a particular projection comprising:

a particular top portion facing the particular non-discharge portion and extending along the particular non-discharge portion, wherein the particular top portion is configured to support the recording medium conveyed by the conveyer, and wherein the particular top portion is sloped, such that a distance between the particular top portion and the discharge surface increases toward the reference line in a direction perpendicular to an extending direction of the particular top portion.

* * * * *